US005515626A

United States Patent [19]

Hölscher

[11] Patent Number: 5,515,626

[45] Date of Patent: May 14, 1996

[54] COUPLING DEVICE

[75] Inventor: Billy Hölscher, Lidköping, Sweden

[73] Assignee: SMP Parts AB, Lidkoping, Sweden

[21] Appl. No.: 325,431

[22] PCT Filed: Mar. 30, 1993

[86] PCT No.: PCT/SE93/00267

§ 371 Date: Sep. 28, 1994

§ 102(e) Date: Sep. 28, 1994

[87] PCT Pub. No.: WO93/20292

PCT Pub. Date: Oct. 14, 1993

[30] Foreign Application Priority Data

Apr. 1, 1992 [SE] Sweden ..... 9201013

[51] Int. Cl.[6] ..... E02F 3/76

[52] U.S. Cl. ..... 37/468; 37/379; 37/443; 414/723

[58] Field of Search ..... 37/379, 443, 468, 37/403; 414/722, 723, 724; 74/425, 425.5, 426, 427, 450

[56] References Cited

U.S. PATENT DOCUMENTS

| | | | |
|---|---|---|---|
| 3,343,693 | 9/1967 | Becker . | |
| 4,032,025 | 6/1977 | Ross | 414/722 X |
| 4,324,055 | 4/1982 | Hippensteel et al. | 37/283 |
| 4,586,393 | 5/1986 | Mooney et al. | 74/425 X |
| 4,674,945 | 6/1987 | Hulden . | |
| 4,779,364 | 10/1988 | Holmoal | 37/468 X |
| 4,906,161 | 3/1990 | Weyer | 37/403 X |
| 5,024,010 | 6/1991 | Hulden . | |
| 5,242,258 | 9/1993 | Weyer | 414/723 |
| 5,327,812 | 7/1994 | Weyer et al. | 414/722 X |
| 5,382,110 | 1/1995 | Perotto et al. | 414/724 X |

FOREIGN PATENT DOCUMENTS 1272698 8/1990 Canada .

*Primary Examiner*—Terry Lee Melius
*Assistant Examiner*—Thomas A. Beach
*Attorney, Agent, or Firm*—Nixon & Vanderhye

[57] ABSTRACT

A coupling device for connection between the operating arm of an excavator and an implement (e.g. bucket) has upper and lower supports and a tilting device having a hinge with a tilt central axis and a transmission gear mounted to the upper and lower supports for tilting of the implement and the lower support part. The gear is a worm gear which has a segment of a worm wheel which is rigidly connected to the upper support and has its center coinciding with the tilt central axis, and a worm screw rotatably journalled to the lower support and rotated by a reversible hydraulic motor to effect tilting about the tilt central axis.

15 Claims, 3 Drawing Sheets

COUPLING DEVICE

The present invention relates to a coupling device for connection between the operating arm of an excavator and an implement, comprising an upper support part pivotably journalled on a shaft of the operating arm to enable controlled turning of the implement and coupling device about said shaft, a lower support part rigidly connected to the implement, a tilting device comprising hinge means located at opposite portions of the upper and lower support parts and forming a tilt central axis which is substantially perpendicular to said shaft, and a transmission means arranged at the upper and lower support parts for controlled tilting of the implement and the lower support part about said tilt central axis, said transmission gear means comprises a reversible hydraulic motor, a first gear element rigidly connected to the one support part and having its centre coinciding with said tilt central axis, and a second gear element connected to the other support part.

A coupling device present on the market has a tilting device which comprises one or two hydraulic cylinders arranged on one or both sides of the coupling device and extending obliquely upwards a considerably distance, as well as past the attachment point between coupling device and stick. The use of hydraulic cylinders connected to the excavator's hydraulic system, and their relatively sturdy attachment lugs and attachment arms greatly increases the weight of the coupling device. The location and size of the hydraulic cylinders also impede the vision of the machine operator. The hydraulic cylinders and their attachment parts also undesirably increase the width of the coupling device. Since the bucket or other implement must often work in relatively narrow areas, it is advantageous for the width of the coupling device to be as little as possible. The location of the hydraulic cylinders also entails considerable risk of their being damaged when coming into contact with objects in the vicinity during manipulation of the bucket. Neither do the hydraulic cylinders permit smooth movement of the bucket during tilting, and the bucket movement will be jerky when they are engaged. The hydraulic cylinders increase the height of the coupling device, thereby requiring more storage and transport space. The tilting is limited by the stroke length of the hydraulic cylinders and a compromise must therefore be made, for instance, between construction height and stroke length. Arranging the supply hoses for the hydraulic cylinders is relatively complicated due to the location and extension of the hydraulic cylinders and there is also risk of the hoses being damaged by objects in the vicinity with which the coupling device comes into contact during manipulation of the bucket or other implement.

A coupling device of the type defined in the introduction is known through U.S. Pat. No. 3,343,693. The transmission gear means shown therein is enclosed by a housing and has both a worm gear and a gear wheel in order to transmit the forces from a hydraulic cylinder. Such a built-in transmission gear means is difficult to maintain and consists of many cooperating parts resulting in increased manufacturing costs and unstable construction. The function becomes worse owing to, inter alia, the fact there are three separate points for the power transmission.

The object of the present invention is to provide a coupling device with an improved tilt device; that results in a coupling device having desired low weight; that lacks hydraulic cylinders to impede the vision; that runs more smoothly than tilt devices in the form of hydraulic cylinders; that can be tilted within a desired great angle area; that has a desired low construction height; that has a simple and reliable hose arrangement; that consists of few parts so that a compact and stable construction is formed; that is easy to maintain; and that has only one point within the gear means for the power transmission.

The coupling device according to the invention is characterized substantially in that said first and second gear elements together form a worm gear, and that the first gear element consists of a segment of a worm wheel, and the second gear element consists of a worm screw rotatably journalled at the other support part to be rotated by the hydraulic motor and being in power transmitting engagement with the worm wheel segment.

The invention will be described further in the following with reference to the drawings.

Figure 1:
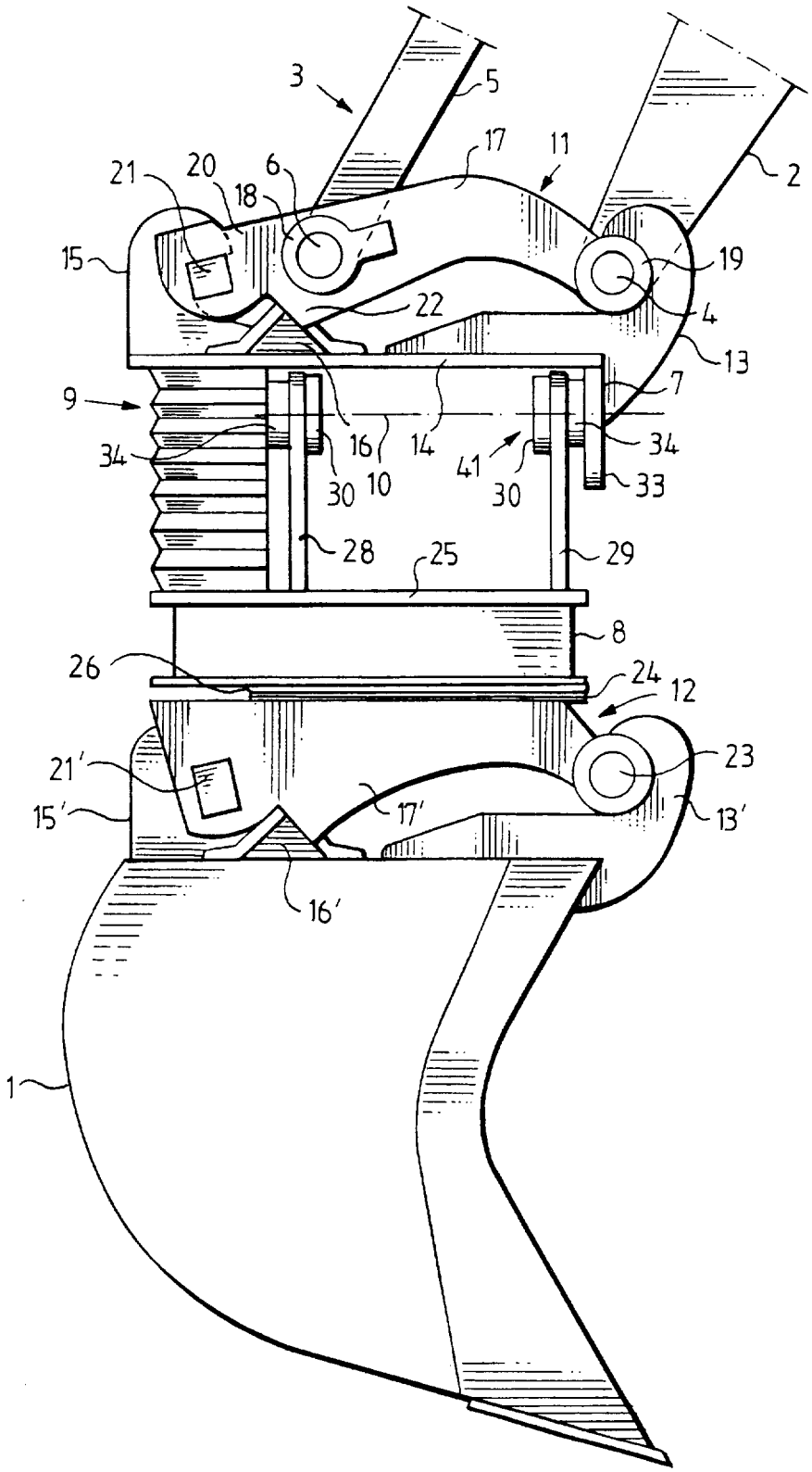
FIG. 1 is a side view of a coupling device and parts of the operating arm of an excavator that, via the coupling device, supports a bucket tiltable by means of a tilt device according to the present invention, enclosed in a protection member.
Figure 2:
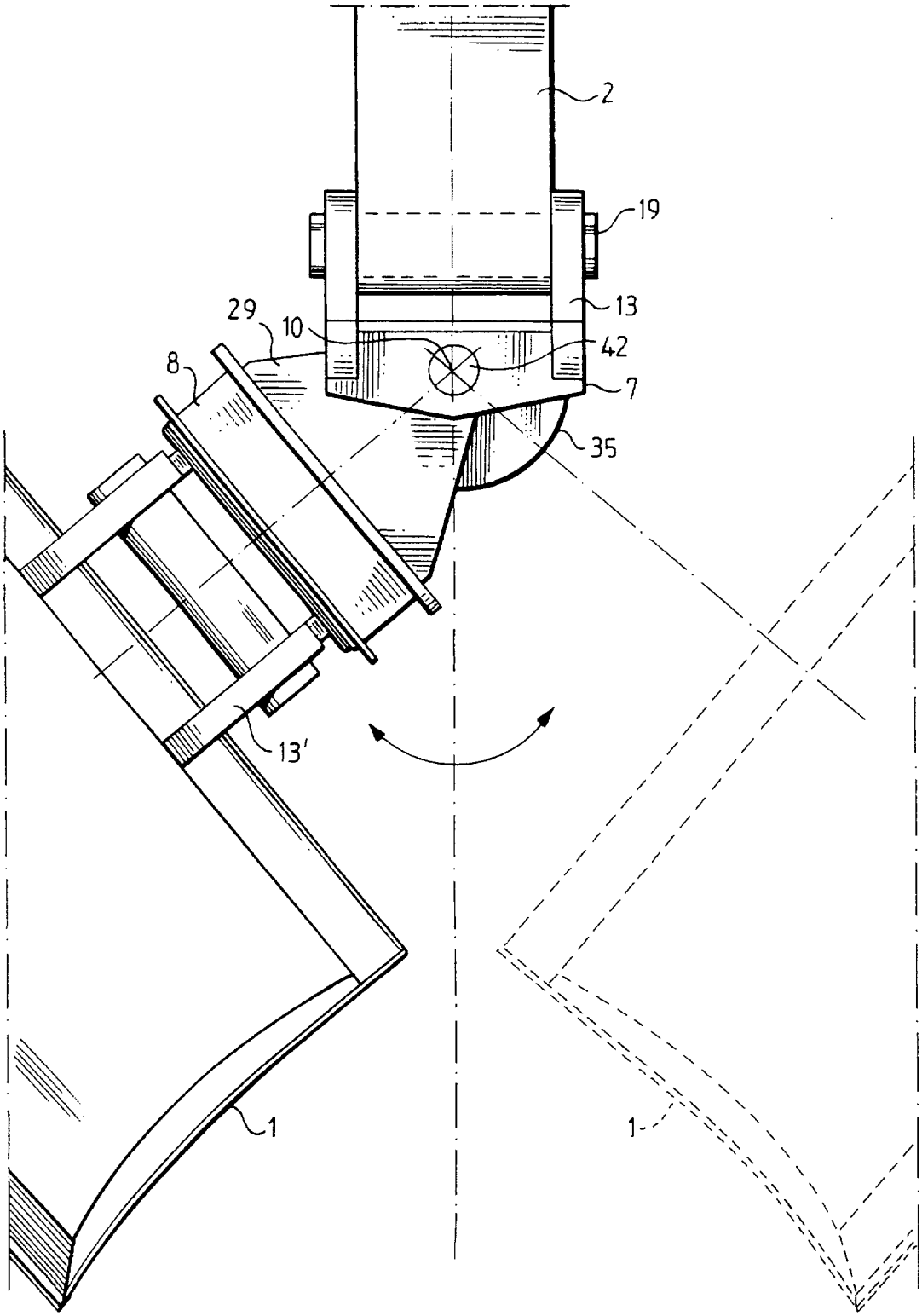
FIG. 2 is an end view of the coupling device, operating arm and bucket according to FIG. 1 in a position inclined to one side as indicated in unbroken lines, and to the other side as indicated in broken lines.

FIGS. 1 and 2 show schematically a coupling device for connecting an implement 1, such as a bucket, to the operating arm of an excavator comprising a stick 2 with an actuator 3 on its front side (facing away from the excavator), said actuator 3 comprising a hydraulic cylinder (not shown) for operating the bucket 1 via the coupling device. The stick 2 is provided at its free end with a horizontal shaft 4 on which the coupling device is pivotably journalled to form the pivoting centre for the bucket 1 and intermediate coupling device. The actuator 3 is provided with a break link 5 carrying a horizontal shaft 6 which is parallel to the shaft 4 and thus situated in front of the shaft 4, and connected by way of a joint to the coupling device. The hydraulic cylinder enables a controlled pivoting movement of the bucket 1 about the axis of the shaft 4 in stick 2.

The coupling device comprises an upper support part 7, a lower support part 8 and a tilt device 9, said tilt device comprising hinge means 41 located at opposite portions of the upper and lower support parts 7, 8 and forming a tilt central axis 10 at the transition or connection between the two support parts 7, 8 said tilt central axis 10 being substantially perpendicular to said shaft 4 of the stick 2.

In the preferred embodiment shown, the connections between the coupling device and operating arm on the one side and the bucket 1 on the other side are effected by means of upper and lower quick couplings 11, 12. The upper quick coupling 11 preferably consists of the type described in EP-0 139 652 or EP-0 368 915. The upper quick coupling 11 comprises two hooks 13 spaced apart and welded to one side portion of a flat plate 14 of the upper support part 7, and a wedge support 15 welded to the opposite side portion of the plate 14. Two boss-shaped counter members 16 are welded to the plate 14 at a predetermined point between the hooks 13 and wedge support 15. The upper quick coupling 11 also includes two parallel link arms 17 with bushings 18, 19 to journal said shafts 4 and 6, respectively. The bushings 18 which receive the shaft 4 of the stick are provided with outer support surfaces cooperating with corresponding inner support surfaces on the inwardly facing hooks 13. Each link arm 17 is provided with an opening to receive a locking device 21 arranged to be brought, by means of wedge action, into abutment with an inner support surface of said wedge support 15, the link arm 17 being provided on its lower side with a counter member 22 arranged to cooperate with the fixed counter member 16 on the plate 14 when the locking device 21 is brought into abutment with the wedge support 15. Removal of the locking device 21 thus disengages the stick 2 and its actuator 3 from the coupling device whereupon one part, namely the link arms 17, of the upper quick coupling 11 supported by the stick 2 and actuator 3, is separated from the other part, namely the hooks 13, counter member 16 and wedge support 15 of the upper quick coupling 11 which are stationary on the plate 14.

The lower quick coupling 12 is constructed in accordance with the same principle as the upper quick coupling 11 and the same designations with a bis-symbol (') added are therefore utilized to define equivalent parts. In this case the hooks 13', wedge support 15' and counter member 16' are welded to a flat upper side of the bucket 1 or to a flat plate which is welded to the bucket 1, whereas the link arms 17' are rigidly connected to a shaft pivot 23 and welded to the lower side of a flat plate 24 of the lower support part 8. Disengagement of the locking device 21' thus enables the whole coupling device, together with the upper part of the lower quick coupling 12, to be removed from the bucket 1 by lifting the stick 2.

Figure 3:
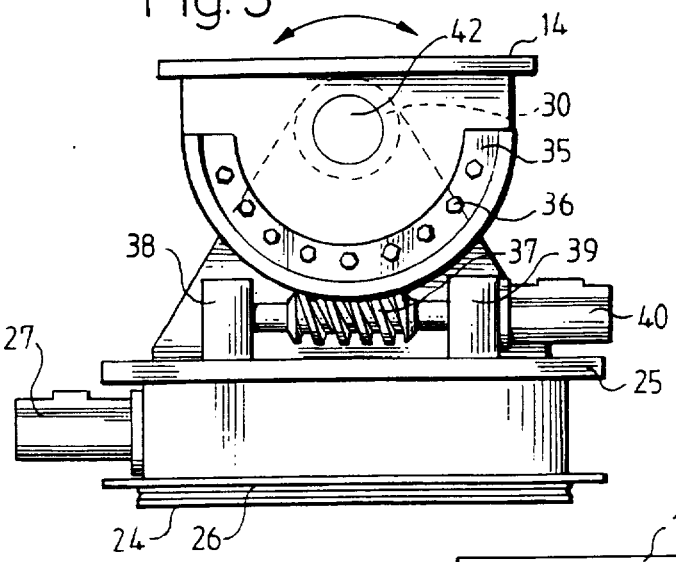
FIG. 3 is an end view of the coupling device according to FIG. 1, and its tilt device according to the invention.
Figure 4:
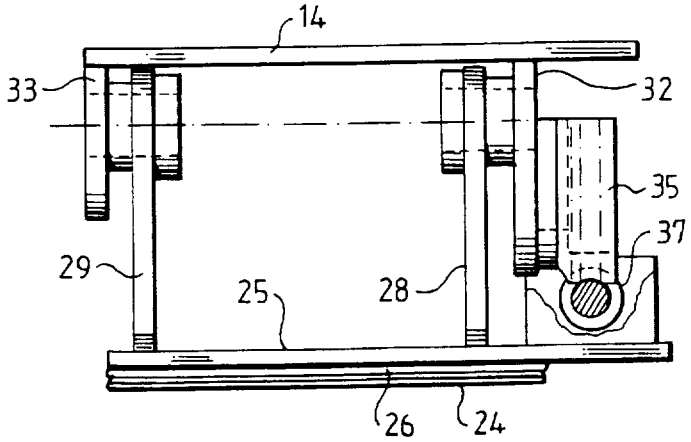
FIG. 4 is a side view of the coupling device and tilt device according to FIG. 3.
Figure 5:
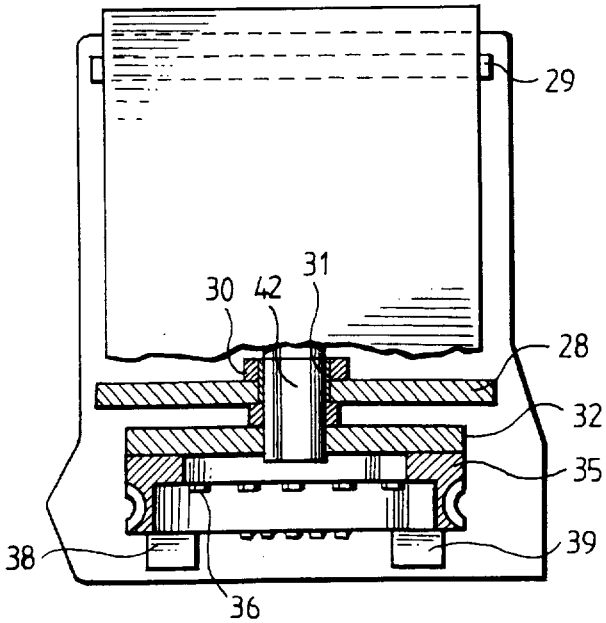
FIG. 5 is a top view of the coupling device and tilt device according to FIG. 3, the tilt device being shown partly in section.

The lower support part 8 comprises a flat inner plate 25 supporting a first part of the tilt device 9 according to the invention. In the preferred embodiment shown the coupling device is also provided with a rotation device 26 mounted between said plates 24, 25 in a cylindrical housing and consisting of a worm gear (not shown). This worm gear is driven by a reversible hydraulic motor 27 (FIG. 3) mounted on the outside of the housing. The rotation device is arranged to rotate the bucket 1 and the lower quick coupling 12 together with the plate 24 in either direction about an axis of rotation perpendicular to the plates 24, 25. The rotation device may be omitted if desired.

In order to obtain said hinge means 41 the lower support part 8 is provided with two upright bearing elements 28, 29 spaced from each other and welded to the inner plate 25. Each bearing element 28, 29 is provided at its top portion with a through-opening and a ring 30 welded on the inside, a bearing bushing 31 being mounted in the ring 30 and said opening. The two bearing bushings 31 are thus aligned with each other and their centres coincide with said tilt central axis 10.

To complete said hinge means 41, the upper support part 7 is provided with two downwardly directed bearing elements 32, 33, spaced apart and welded to the plate 14. Each bearing element 32, 33 is provided at its lower end with a through-opening and a ring 34 welded on the inside. A shaft pivot 42 is arranged to extend through the pair of bearing elements 28, 32; 29, 33 and their rings and bearing bushings. The coaxial shaft pivots 42 and their bearing elements 28, 32; 29, 33 thus form said tilt central axis 10.

One of the downwardly directed bearing elements 32, 33 is extended downwardly and laterally in order to provide a free mounting portion. According to the present invention the tilt device comprises a transmission gear means in the form of a worm gear that cosists of a first gear element in the form of a segment of a worm wheel 35, and a second gear element in the form of a worm screw 37. In the embodiment shown the worm wheel segment 35 encloses a sector angle of 180°. The worm wheel segment 35 is secured to said enlarged bearing element 32 by means of a plurality of bolts 36. The worm screw 37 of the worm gear is mounted on the lower support part 8 of the coupling device. The worm screw 37 is rotatably journalled in two bearings, the bearing housings 38 of said bearings being secured to the inner plate 25, spaced from each other and on each side of an extended central line of the worm wheel segment 35 intersecting the tilt central axis 10 seen in untilted starting position. The worm screw 37 extends tangentially beneath the worm wheel segment 35 and is in engagement therewith. The worm screw 37 is driven by a reversible hydraulic motor 40, mounted on one of the bearing housings. Upon rotation of the worm screw 37 in either direction, therefore, the lower support part 8 of the coupling device and the bucket 1 can be brought into a desired inclined side position to the left or right of the normal vertically suspended position since the worm wheel segment 35 is stationary while the worm screw 37 moves in an arc along the worm wheel segment 35 while being in permanent engagement therewith.

Designing the tilt device in accordance with the present invention allows the bucket 1 to be inclined relatively far, e.g. ±55° as in the embodiment shown. The tilting device according to the invention consists of few parts and therefore it forms a compact and stable construction. Power transmission occurs only at one point. Furthermore, the tilting device is placed externally in such a way that it is easy to maintain.

I claim:

1. An excavator component assembly comprising:

an excavator operating arm including a shaft, defining a first, pivot axis;

an excavator implement;

a first support pivotally journalled on said shaft;

a second support rigidly connected to said excavator implement;

a hinge connection between said first and second supports, including a second pivot axis which is substantially perpendicular to said first pivot axis;

a worm wheel rigidly connected to one of said first and second supports and having a center coinciding with said second pivot axis;

a worm screw connected to the other of said first and second supports and rotatable with respect thereto about a third axis substantially parallel to said first axis, said worm wheel and worm screw meshing with each other; and a reversible hydraulic motor connected to said worm screw for driving said worm screw to in turn drive said worm wheel to effect pivotal movement of said second part with respect to said first part about said second axis.

2. An assembly as recited in claim 1 wherein said worm wheel is connected to said first support and said worm screw to said second support.

3. An assembly as recited in claim 2 further comprising an upper quick coupling, coupling said operating arm to said first support.

4. An assembly as recited in claim 3 further comprising a lower quick coupling, coupling said implement to said second support.

5. An assembly as recited in claim 2 wherein said hinge connection is defined by: first and second bearing elements rigidly attached to said first support and spaced from each other along said second axis; third and fourth bearing elements rigidly attached to said second support and spaced from each other along said second axis; each said bearing elements including a bearing ring and a bearing bushing; and first and second pivot pins connecting together said first and third and second and fourth bearing elements, respectively, said pivot pins spaced from each other along said second axis and concentric with said second axis; said worm wheel connected to said first pivot pin.

6. An assembly as recited in claim 5 wherein said worm wheel has a sector angle of about 180°.

7. An assembly as recited in claim 6 wherein comprising a rotation device mounted between said second support and said implement for providing rotation of said implement with respect to said second support about a fourth axis substantially perpendicular to both said second and third axes; and a second hydraulic motor for rotating said implement about said fourth axis.

8. An assembly as recited in claim 8 wherein said implement comprises a bucket.

9. An assembly as recited in claim 1 wherein said hinge connection is defined by: first and second bearing elements rigidly attached to said first support and spaced from each other along said second axis; third and fourth bearing elements rigidly attached to said second support and spaced from each other along said second axis; each said bearing elements including a bearing ring and a bearing bushing; and first and second pivot pins connecting together said first and third and second and fourth bearing elements, respectively, said pivot pins spaced from each other along said second axis and concentric with said second axis; said worm wheel connected to said first pivot pin.

10. An assembly as recited in claim 1 wherein said worm wheel has a sector angle of about 180°.

11. An assembly as recited in claim 1 further comprising a rotation device mounted between said second support and said implement for providing rotation of said implement with respect to said second support about a fourth axis substantially perpendicular to both said second and third axes; and a second hydraulic motor for rotating said implement about said fourth axis.

12. A coupling device for connection between an operating arm and an implement of an excavator, comprising:

a first support connected to said operation arm including a bushing, said bushing defining a first pivot axis;

a second support;

a hinge connection between said first and second supports, including a second pivot axis which is substantially perpendicular to said first pivot axis;

a worm wheel rigidly connected to said first support and having a center coinciding with said second pivot axis;

a worm screw connected to said second support and rotatable with respect thereto about a third axis substantially parallel to said first axis, said worm wheel and worm screw meshing with each other; and a reversible hydraulic motor connected to said worm screw for driving said worm screw to in turn drive said worm wheel to effect pivotal movement of said second part with respect to said first part about said second axis.

13. A coupling device as recited in claim 12 wherein said hinge connection is defined by: first and second bearing elements rigidly attached to said first support and spaced from each other along said second axis; third and fourth bearing elements rigidly attached to said second support and spaced from each other along said second axis; each said bearing elements including a bearing ring and a bearing bushing; and first and second pivot pins connecting together said first and third and second and fourth bearing elements, respectively, said pivot pins spaced from each other along said second axis and concentric with said second axis; said worm wheel connected to said first pivot pin.

14. A coupling device as recited in claim 13 wherein said worm wheel has a sector angle of about 180°.

15. A coupling device as recited in claim 12 wherein said worm wheel has a sector angle of about 180°.

* * * * *